US007540034B2

(12) United States Patent
Bologna

(10) Patent No.: US 7,540,034 B2
(45) Date of Patent: Jun. 2, 2009

(54) FACE GUARD FOR A SPORTING HELMET

(75) Inventor: Vittorio Bologna, Westmount (CA)

(73) Assignee: Sport Maska Inc., Montreal, Quebec (CA)

( * ) Notice: Subject to any disclaimer, the term of this patent is extended or adjusted under 35 U.S.C. 154(b) by 364 days.

(21) Appl. No.: 11/132,583

(22) Filed: May 19, 2005

(65) Prior Publication Data

US 2006/0053520 A1 Mar. 16, 2006

(51) Int. Cl.
*A42B 3/20* (2006.01)

(52) U.S. Cl. ..... 2/9; 2/424

(58) Field of Classification Search ..... 2/9, 2/424, 425, 422, 421
See application file for complete search history.

(56) References Cited

U.S. PATENT DOCUMENTS 4,631,758 A 12/1986 Newman et al.
5,661,849 A * 9/1997 Hicks ..... 2/9
5,713,082 A * 2/1998 Bassette et al. ..... 2/412
5,806,088 A 9/1998 Zide et al.
6,421,829 B2 * 7/2002 Halstead et al. ..... 2/9
6,499,139 B1 12/2002 Brown et al.
6,598,234 B1 7/2003 Brown et al.
6,637,091 B2 * 10/2003 Halstead et al. ..... 2/9
6,763,524 B2 * 7/2004 Halstead et al. ..... 2/9
7,127,747 B2 10/2006 Darnell et al.
2003/0070201 A1 4/2003 McClelland
2006/0044193 A1 3/2006 Fukushima
2006/0053520 A1 3/2006 Bologna
2006/0117449 A1 6/2006 Hahn et al.
2006/0143765 A1 7/2006 Halstead et al.

FOREIGN PATENT DOCUMENTS

CA 2228336 5/2007

* cited by examiner

*Primary Examiner*—Danny Worrell
(74) *Attorney, Agent, or Firm*—Ogilvy Renault LLP

(57) ABSTRACT

The present invention is dedicated to a face mask for a sporting helmet, the face mask being an integral one-piece cast metal comprising a plurality of curved longitudinal members and a plurality of rising members joining each other thereby defining a plurality of apertures.

14 Claims, 4 Drawing Sheets

FACE GUARD FOR A SPORTING HELMET

TECHNICAL FIELD

The present invention relates generally to a face guard for a sporting helmet, and particularly to a face guard for use by hockey players.

BACKGROUND

The sport of hockey subjects its participants to a high risk of head and facial injuries. Much of the risk results directly from the implements used during play of a game. Specifically, the hard rubber pucks used in the game are propelled at extremely high velocities and can produce serious injury when striking delicate parts of a body, especially the eyes.

Hockey helmets have significantly reduced the incidence of head injury and the introduction of protective face guards, including both transparent plastic shields and welded steel-wire cages, have reduced the likelihood of facial injury. Prior protective face guards have exhibited various drawbacks that either limit their effectiveness or render them objectionable to a high percentage of players. For example, plastic shields have a tendency to impair vision by accumulating condensation during certain environmental conditions, while welded steel-wire face guards are relatively heavy and are prone to corrosion and failure at the soldering points.

SUMMARY

In accordance with one aspect of the present invention, there is provided an integral one-piece cast metal face guard having advantageous weight, corrosion-resistance and strength characteristics as compared to welded steel-wire face guards.

In accordance with another aspect of the present invention, there is provided a face mask for a sporting helmet, the face mask being an integral one-piece cast titanium comprising a plurality of curved longitudinal members and a plurality of rising members joining each other thereby defining a plurality of apertures.

In accordance with a further aspect of the present invention, there is provided a face mask for a sporting helmet, wherein the plurality of curved longitudinal members and the plurality of rising members have a circular cross-section.

In accordance with a still further aspect of the present invention, there is provided face mask wherein the plurality of rising members have an elliptical cross-section, the elliptical cross-sections having major axes oriented in a same direction or in a direction perpendicular to the curvature of the longitudinal members.

In accordance with a yet another aspect of the present invention, there is provided face mask for a sporting helmet comprising at least two integral one-piece cast metal parts, each of the parts comprising a plurality of curved longitudinal members and a plurality of rising members crossing each other thereby defining a plurality of apertures.

BRIEF DESCRIPTION OF THE FIGURES

Embodiments of the invention will be described by way of example only with reference to the accompanying drawings, in which.

DETAILED DESCRIPTION

Figure 1:
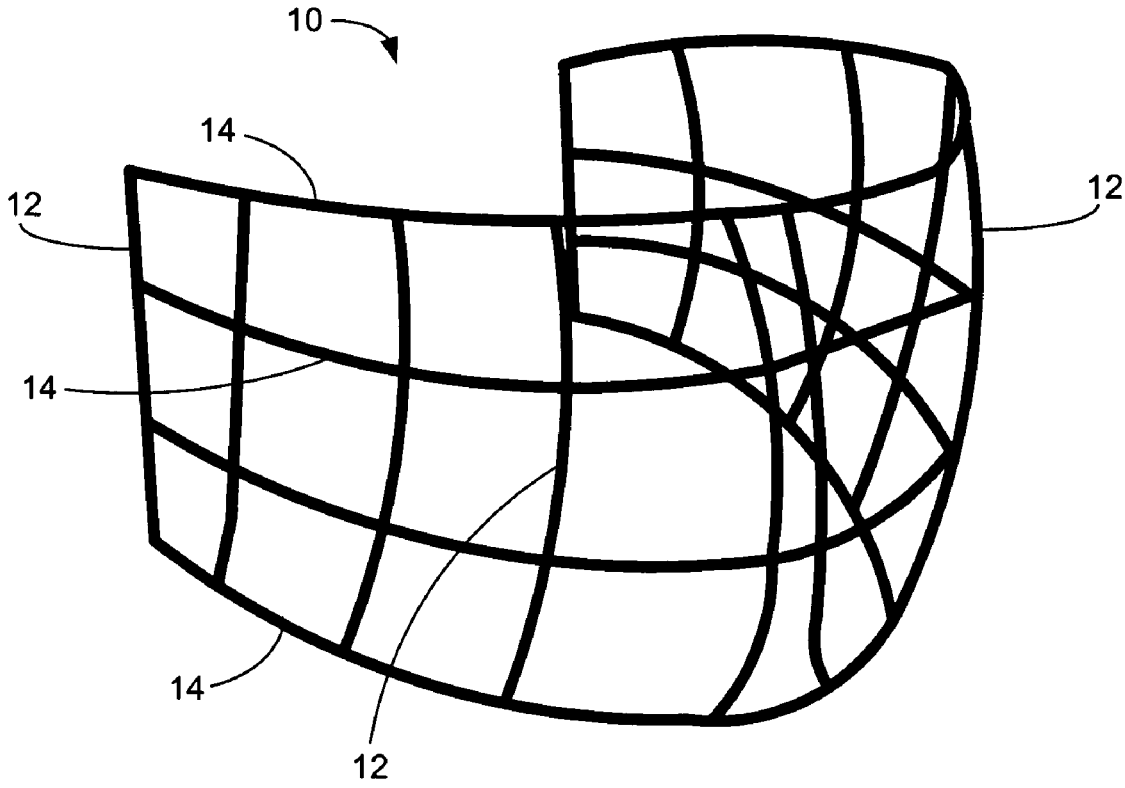
FIG. 1 shows a perspective view of a cast metal face guard.
Figure 2:
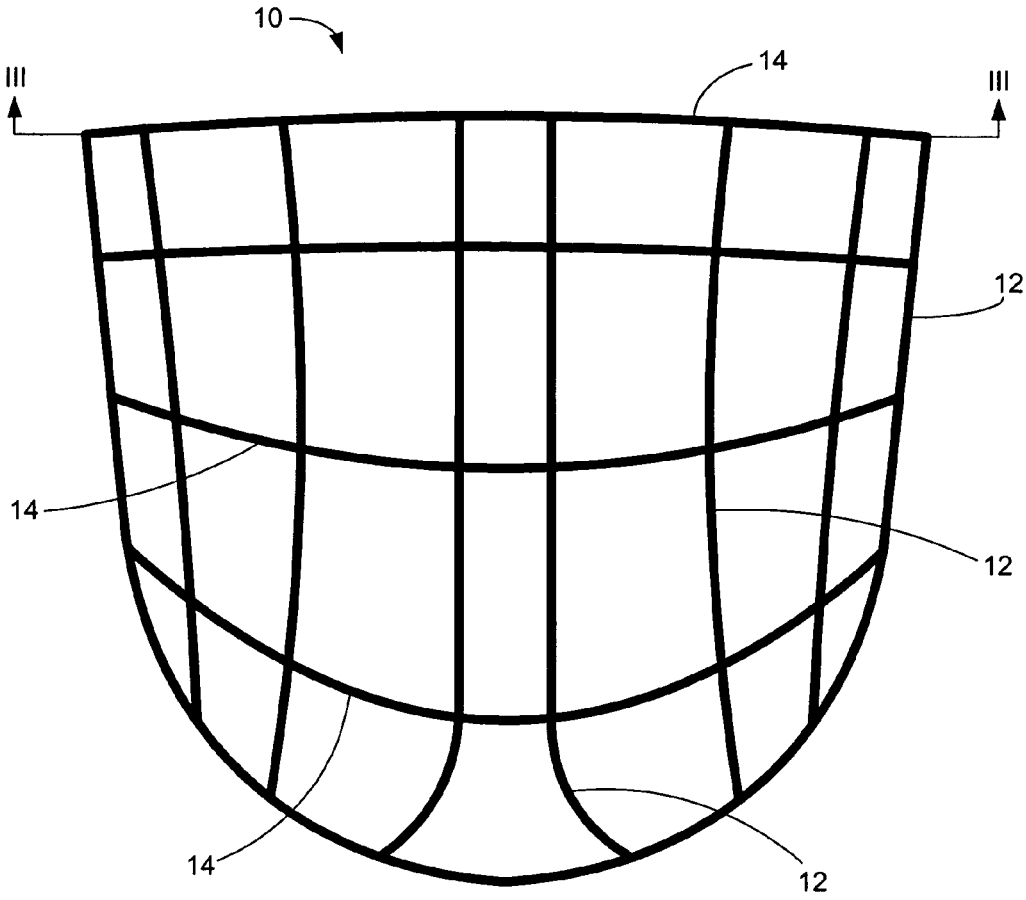
FIG. 2 shows a front elevation view of the cast metal face guard of FIG. 1.

Reference is made to FIGS. 1 and 2 which represent a cast metal face guard 10 according to a particular embodiment of the present invention. The face guard 10 defines a protective cage extending in front of the wearer's face when attached to the front portion of a helmet. The cage is formed of curved longitudinal members 12 and rising members 14 crossing (through) each other at various angles forming a plurality of apertures sufficiently small to prevent the passage of objects such as, for example, a hockey puck or a butt end of a hockey stick. However, unlike typical wire mesh face guards, the cast metal face guard 10 is cast as a single piece instead of being made of a plurality of wire meshes which have to be welded together, making it lightweight and very resistant, eliminating the need of soldering points between the various wires meshes. The metal used is preferably titanium but could be other metals such as, for example, steel, aluminum, an alloy or a combination thereof. FIG. 3 shows a cross sectional view (along axis III-III as shown in FIG. 2) of the cast metal face guard 10 of FIG. 2, showing curved longitudinal members 12 and rising members 14 which may have a generally circular cross-section.

Figure 3A:
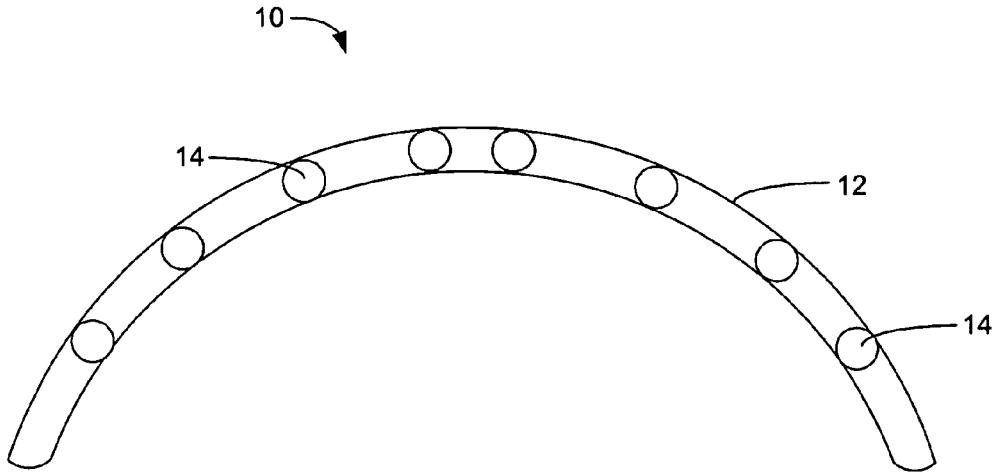
FIG. 3*a* shows a cross sectional view (along axis III-III as shown in FIG. 2) of the cast metal face guard of FIG. 2.
Figure 3B:
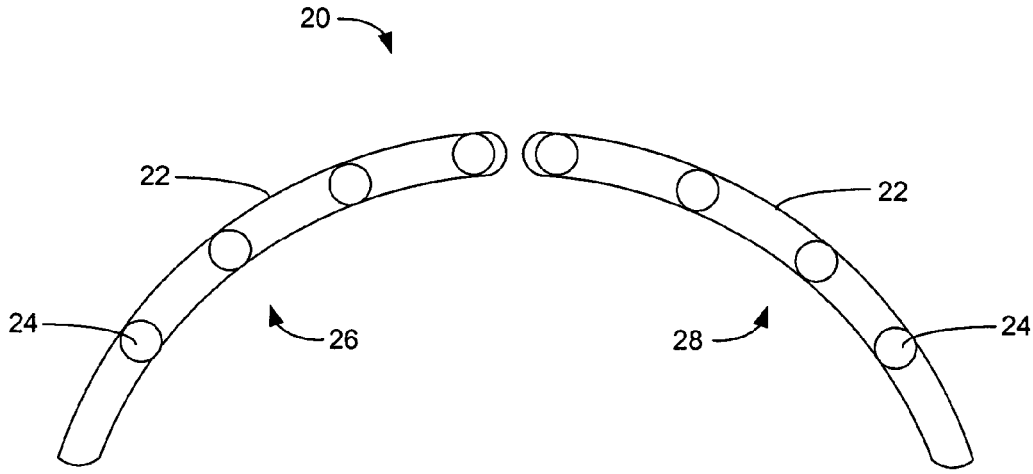
FIG. 3*b* shows a cross sectional view (along axis III-III as shown in FIG. 2) of an alternative embodiment of the cast metal face guard of FIG. 2.
Figure 3C:
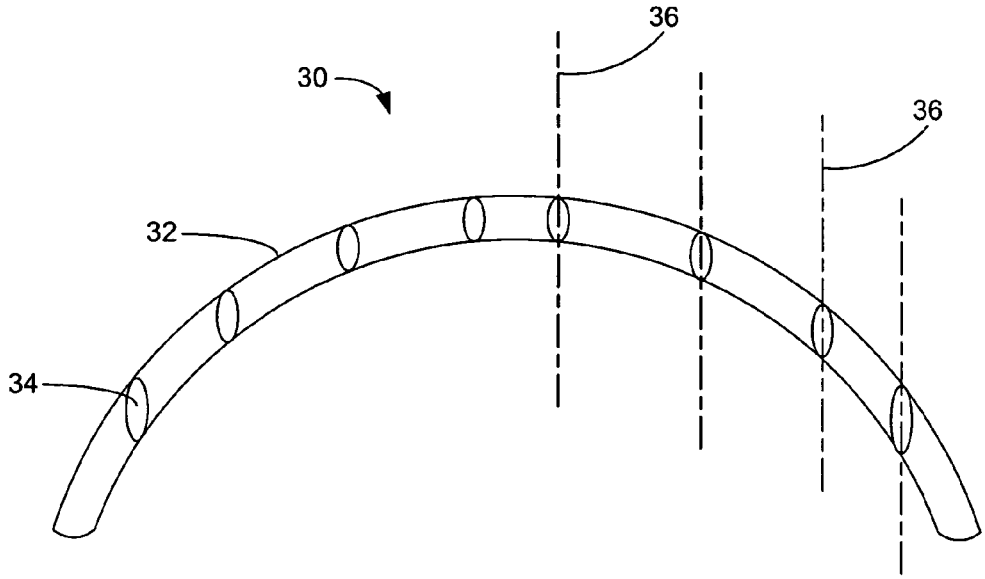
FIG. 3*c* shows a cross sectional view (along axis III-III as shown in FIG. 2) of another alternative embodiment of the cast metal face guard of FIG. 2.
Figure 3D:
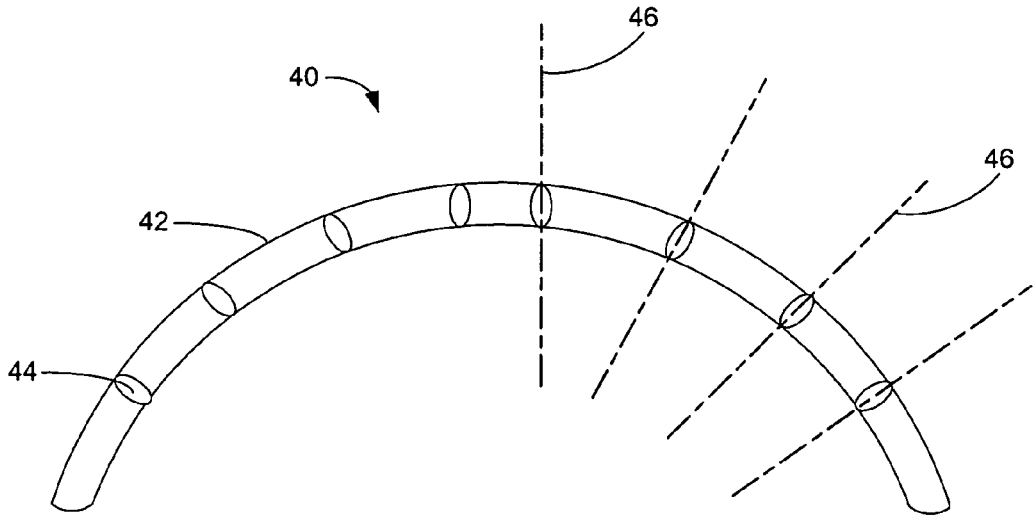
FIG. 3*d* shows a cross sectional view (along axis III-III as shown in FIG. 2) of a further alternative embodiment of the cast metal face guard of FIG. 2.

FIGS. 3*b* to 3*d* illustrate alternate embodiments of the cast metal face guard. Namely, FIG. 3*b* illustrates an alternate cast metal face guard 20 which has similar curved longitudinal members 22 and rising members 24 layout as the cast metal face guard 10 of FIGS. 1 to 3*a* but is made of two separate cast metal half-guards 26, 28. Another embodiment of the cast metal face guard 30 is illustrated by FIG. 3*c*, in which the rising members 34 may have a generally elliptical cross-section, having all their major axes 36 oriented in the same general direction. A further embodiment of the cast metal face guard 40 is illustrated by FIG. 3*d*, in which the rising members 44 may also have a generally elliptical cross-section but having their major axes 46 oriented in a perpendicular direction to the curvature of the longitudinal members 42 or radially from a point inwardly (not shown). As may be understood, a further embodiment of the cast metal face guard 40 may have rising members 44 which may have a generally elliptical cross-section, but each adjacent rising member 44 may have a different shaped ellipse. As may be understood, rising members 44 need to be strong in order to support impacts thereon. Alternatively, rising members 44 must also be as narrow as possible in order to minimize the impact on the field of vision that rising members 44 cause to the player. Thus, by concentrating the material of the rising members 44 along major axes 36, the amount of material available to resist impact is unchanged, and the ability of the rising members 44 to resist bending moment (i.e. impacts) thereon is improved. As may be understood, as a player's field of vision changes from directly in front of him to the periphery, the cross-sectional shape of the rising members 44 may change in order to minimize the effect on the field of vision.

It is to be understood that the curved longitudinal members 12, 22, 32, 42 may be of the same or different geometry than that of the corresponding rising members 14, 24, 34, 44. As well, the layout and number of longitudinal members and rising members may be different then the one illustrated in FIGS. 1 to 3*d*. Furthermore, mixtures of individual longitudinal members and rising members cross-sections together with mixtures of layouts are possible.

Although the present invention has been described by way of particular embodiments and examples thereof, it should be noted that it will be apparent to persons skilled in the art that modifications may be applied to the present particular embodiment without departing from the scope of the present invention.

What is claimed is:

1. A face mask for a sporting helmet, said face mask being an integral one-piece cast metal comprising a plurality of curved longitudinal members and a plurality of rising members joining each other thereby defining a plurality of apertures, at least some of the plurality of rising members having an elliptical cross-section, major axes of the elliptical cross-sections being oriented in a direction perpendicular to a curvature of said plurality of longitudinal members or radially from a point inwardly.

2. A face mask according to claim 1, wherein said metal is titanium.

3. A face mask according to claim 1, wherein said plurality of curved longitudinal members have a circular cross-section.

4. A face mask according to claim 1, wherein said plurality of curved longitudinal members have an elliptical cross-section.

5. A face mask according to claim 1, wherein said major axes are all oriented in the direction perpendicular to the curvature of said plurality of longitudinal members.

6. A face mask for a sporting helmet, said face mask comprising at least two integral one-piece cast metal parts, each of said at least two integral one-piece cast metal parts comprising a plurality of curved longitudinal members and a plurality of rising members crossing each other thereby defining a plurality of apertures, wherein for each of said one-piece cast metal parts, at least some of the plurality of rising members have an elliptical cross-section with major axes of the elliptical cross-sections being oriented in a direction perpendicular to a curvature of the longitudinal members or radially from a point inwardly.

7. A face mask according to claim 1, wherein the major axes are all oriented radially from a point inwardly.

8. A face mask according to claim 1, wherein at least some of the elliptical cross-sections have a different shape from one another.

9. A face mask according to claim 6, wherein said metal is titanium.

10. A face mask according to claim 6, wherein the curved longitudinal members have a circular cross-section.

11. A face mask according to claim 6, wherein the curved longitudinal members have an elliptical cross-section.

12. A face mask according to claim 6, wherein for each of said one-piece cast metal parts, the major axes are all oriented in the direction perpendicular to the curvature of the plurality of longitudinal members.

13. A face mask according to claim 6, wherein for each of said one-piece cast metal parts, the major axes are all oriented radially from a point inwardly.

14. A face mask according to claim 6, wherein the elliptical cross-sections of at least some of the rising members differ from one another.

* * * * *